United States Patent [19]

Cuvar et al.

[11] Patent Number: 4,593,540

[45] Date of Patent: Jun. 10, 1986

[54] PIERCED EARRING WITH SLIDABLE PLASTIC POST AND BACKING

[76] Inventors: Christina L. Cuvar; Robert P. Cuvar, both of RR 1, Box 462, Bunker Hill, Ill. 62014

[21] Appl. No.: 697,225

[22] Filed: Jan. 31, 1985

[51] Int. Cl.[4] ..... A44C 7/00

[52] U.S. Cl. ..... 63/12; 411/337; 63/DIG. 3

[58] Field of Search ..... 63/12, 13; 24/90.5, 24/90 R, 90 A; 411/337, 360, 373

[56] References Cited

U.S. PATENT DOCUMENTS

| | | | |
|---|---|---|---|
| 2,841,848 | 7/1958 | Smith | 63/12 X |
| 3,341,903 | 9/1967 | Buntic | 411/337 X |
| 3,470,637 | 10/1969 | Daddena | 24/90 R |
| 3,910,065 | 10/1975 | Holt | 63/12 |
| 4,067,341 | 1/1978 | Ivey | 63/13 X |
| 4,353,225 | 10/1982 | Rogers | 63/13 |
| 4,353,370 | 10/1982 | Evans | 63/12 X |
| 4,510,772 | 4/1985 | Alley et al. | 63/12 |

*Primary Examiner*—F. Barry Shay

*Attorney, Agent, or Firm*—Grace J. Fishel

[57] ABSTRACT

An improved earring for pierced ears including a plastic post and backing is disclosed, which earring has less tendency to irritate the wearer's pierced ear hole than conventional pierced earrings. The post and clutch may be of nylon and the post is pliable so that it tends to bend if its inward end is pressed against the head or neck.

6 Claims, 3 Drawing Figures

FIG. 1
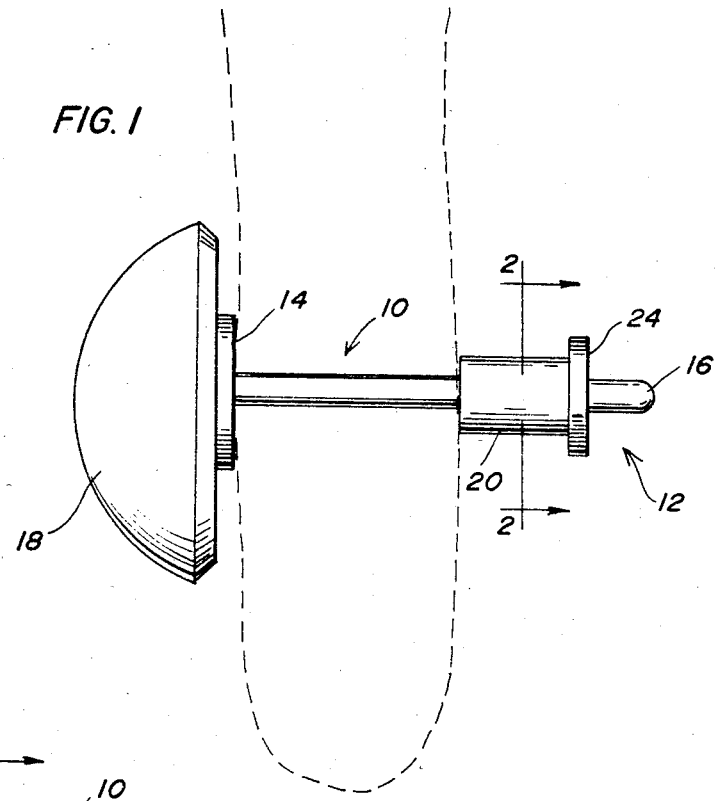
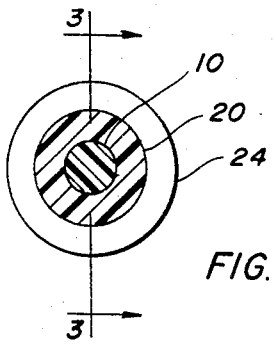
FIG. 2
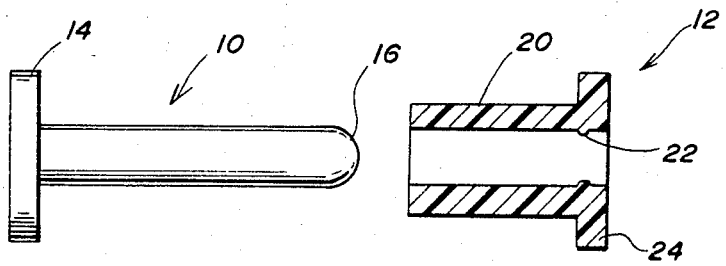
FIG. 3

PIERCED EARRING WITH SLIDABLE PLASTIC POST AND BACKING

The present invention relates to an improved earring for pierced ears.

There are many kinds of nonpierced earrings which clamp or screw on the ear lobe. This kind of earring tends to be heavy and pinches if clamped or screwed on too tight. On the other hand, if it is too lose, the earring many fall off and be lost. This is an annoyance even if the earring is inexpensive as the missing earring can rarely be matched with a replacement, which even then are only sold in pairs.

Pierced earrings are lighter and more secure; however, they too suffer a number of shortcomings, the most serious of which is that they cause irritation and/or infection in the ear hole. The posts of better earrings are made of surgical steel or gold but even with these materials, sometimes advertised as "hypo allergenic", it is estimated that 50 to 75% of all women experience chronic or occasional swelling and discomfort. In some cases, the ear hole may not be irritated by the post but by the finding or by the clutch since the post is typically brazed to the back of the finding and the clutch and finding may be made of some other metal other than surgical steel or gold.

The end of a conventional pierced earring post is cut straight across or pointed and the post usually extends through the earring backing. Many ear holes are not pierced evenly such that the wearer may cut the ear hole with the blunt or pointed end of the post while probing the ear lobe trying to locate the other opening. Because the end of the post also tends to prick or stab the wearer behind the ear, most women who wear pierced earings take them off to use a telephone or to go to bed.

In view of the above, it is an object of the present invention to provide an improved pierced earring which reduces and/or essentially eliminates the possibility of irritation or infection. It is another object to provide a pierced earring which does not cut the ear hole or stab the wearer behind her ear. Other objects and features will be in part apparent and in part pointed out hereinafter. The invention accordingly comprises the constructions hereinafter described, the scope of the invention being indicated by the subjoined claims.

In the drawings one of several possible embodiments of the invention is illustrated, in which corresponding numerals refer to corresponding parts and in which:

FIG. 1 is a side elevational view of a plastic post and backing for pierced earrings in accordance with the present invention;

FIG. 2 is a sectional view taken along line 2—2 in FIG. 1; and,

FIG. 3 is a sectional view taken along line 3—3 in FIG. 2.

Referring to the drawings more particularly by reference character, reference numeral 10 refers to a plastic post to which a plastic clutch 12 is frictionally engaged. As best seen in FIG. 1, plastic post 10 includes a base 14, the underside of which abuts the outside of the wearer's ear lobe. Opposite base 14, as shown at 16, the other end of post 10 is rounded for use as described below. Post 10 is typically circular in cross section but may be oval or some other shape.

Base 14 is connected to a decorative member or finding 18. As shown in FIG. 1, base 14 is a generally small, flat circular plate but depending on the finding, it may have other configurations, as for example it may be curved for attachment to a pearl, bead or the like. It is important that base 14 be sized and shaped such that it can be secured to the finding and such that the wearer's ear hole is insulated since the back of the finding may be constructed of some base metal to which the wearer is allergic.

Clutch 12 is illustrated as a right circular cylinder 20 with an internal annular projection 22 adjacent an annular flange 24 located at one end. The inner annular projection need not be placed adjacent the outer annular projection 22 but can be located anywhere along the circular cylinder 20. The inner diameter of cylinder 20 is slightly larger than the outside diameter of post 10 such that it allows for a lead in allowing post 10 easy travel to contact with annular projection 22 which is slightly smaller in diameter than post 10. Annular projection 22 being slightly smaller in diameter than post 10 exerts frictional force sufficient enough to hold clutch 12 on post 10 with a greater frictional force than the force tending to slide the clutch off while the earring is worn but not so much force that the wearer cannot easily slide the clutch on the post with her fingers. The clutch may take other shapes, it being essential that the clutch be penetrated by an insertion hole with an internal projection spaced inwardly from said insertion hole as a lead in for resilient engagement of the post.

Post 10 and clutch 12 are made, usually by molding, of a somewhat soft, resilient plastic material with a fairly high coefficient of friction such as nylon. It is preferred that the diameter of post 10 be about 0.030 to about 0.045 inch, with a diameter of 0.041 inch being especially preferred. If the diameter of post 10 is 0.030 inch or smaller, it is difficult to mold a post which can be threaded through an ear hole. On the other hand, posts having a diameter of 0.045 inch and greater are not favored because most ear holes are smaller than 0.047 inch since that is the diameter of most starter posts. Post 10 is preferably about 0.35 to about 0.45 inch in length from base 14 to rounded tip 16, with a length of about 0.42 inch being particularly preferred.

The insertion hole in clutch 12 is preferably about 0.001 inch larger than the diameter of post 10 thus allowing for easier entry of post 10 into clutch 20 and the internal projection 22 is preferably 0.001 inch smaller than the outside diameter of post 10. The overall length of clutch 12 should be a little more than 0.14 inch shorter than the length of post 10 to accommodate the normal thickness of an ear lobe (about 0.14 inch). It can be even shorter, however, since post 10 is pliable and will not prick or jab the wearer behind the ear where the post overhangs the clutch.

In use, the wearer threads post 10 through an ear hole and slips clutch 12 over rounded end 16. Clutch 12 is then slid along post 10 until it contacts the rear surface of the ear lobe while base 14 is held against the front. This can be accomplished by grasping clutch 12 by flange 24. In some cases, the wearer may prefer to slip clutch 12 on post 10 opposite the direction shown in FIG. 1 such that flange 24 is adjacent the back surface of the wearer's ear lobe. In either case, however, the ear hole is exposed to no metal parts and there is little or no tendency for the ear hole to become irritated or infected. This is an extension of the use of plastics which have been found so useful in storing all sorts of materials such as chemicals (some of which are harsh and corrosive), petroleum products, foods, drinks, even prescription pharmaceuticals and so forth without being degraded by or contaminating the stored materials. Most women find the earrings so comfortable that they can be worn for long periods of time, to bed or while using a telephone. Earrings in accordance with the present invention can also be used as starter earrings without scabbing or otherwise adhering to the ear hole. Since the post and clutch are made of a relatively inexpensive material the wearer can afford a whole wardrobe of earrings with less tendency to cause irritation or infection than gold, thus allowing women to enjoy a new world in fashion at a very moderate price.

In view of the above, it will be seen that the several objects of the invention are achieved and other advantageous results attained. As various changes could be made in the above constructions without departing from the scope of the invention, it is intended that all matters contained in the above description shall be interpreted as illustrative and not in a limiting sense.

What is claimed is:

1. An earring comprising a pliable plastic post to go inwardly through the hole in a pierced ear hole and a pliable plastic and reversible clutch with an insertion hole running the length and open at opposite ends thereof and having a reduced diameter therealong for frictional engagement of the post, said post being longer than the combined length of the hole in the ear lobe and length of the insertion hole in the clutch such that in use the free end of the post overhangs the clutch.

2. The earring of claim 1 wherein the insertion hole in the plastic clutch has an internal projection for resilient engagement of the post.

3. The earring of claim 1 or 2 wherein the post includes a base for attachment to a finding, said base insulating the ear hole from the finding.

4. The earring of claim 2 wherein the clutch includes an outward projection at one end thereof.

5. The earring of claim 4 wherein the post is circular in cross section and wherein the clutch is a right circular cylinder, wherein the internal and outward projections are annular.

6. The earring of claim 4 wherein the post and clutch are made of nylon.

* * * * *